United States Patent [19]

Sarid et al.

[11] 4,110,614

[45] Aug. 29, 1978

[54] CORONA DEVICE

[75] Inventors: Dror Sarid, Rochester; Thomas G. Davis, Pittsford, both of N.Y.

[73] Assignee: Xerox Corporation, Stamford, Conn.

[21] Appl. No.: 751,826

[22] Filed: Dec. 17, 1976

[51] Int. Cl.[2] ..... H01T 19/04

[52] U.S. Cl. ..... 250/324; 250/326

[58] Field of Search ..... 250/324, 326, 310

[56] References Cited

U.S. PATENT DOCUMENTS

| | | | |
|---|---|---|---|
| 3,390,266 | 6/1968 | Epping | 250/326 |
| 3,483,374 | 12/1969 | Erben | 250/324 |
| 3,764,866 | 10/1973 | Bonaventura | 250/324 |
| 3,783,283 | 1/1974 | Smith et al. | 250/324 |
| 3,789,278 | 1/1974 | Bingham et al. | 250/326 |

*Primary Examiner*—Harold A. Dixon

[57] ABSTRACT

A corona charging device having a corona electrode in the form of a conductive wire covered with a thick dielectric coating. The electrode is supported along its entire active length at a spaced distance from both an adjacent conductive plate and an imaging surface to be charged.

10 Claims, 2 Drawing Figures

CORONA DEVICE

BACKGROUND OF THE INVENTION

The present invention relates to a corona charging device for depositing charge on an adjacent surface. More particularly, it is directed to a corona charging arrangement usable in a xerographic reproduction system for generating a flow of ions onto an adjacent imaging surface for altering or establishing an electrostatic charge thereon. Still more particularly, this invention is directed to improved configurations for corona discharge devices of the type disclosed in pending patent application Ser. No. 595,656 in the joint names of T. Davis and G. Safford and U.S. Pat. No. 4,057,723 in the joint names of D. Sarid and B. Springett, both applications being assigned to the assignee of this application.

In the electrophotographic reproducing arts, it is necessary to deposit a uniform electrostatic charge on an imaging surface, which charge is subsequently selectively dissipated by exposure to an information containing optical image to form an electrostatic latent image. The electrostatic latent image may then be developed and the developed image transferred to a support surface to form a final copy of the original document.

In addition to precharging the imaging surface of a xerographic system prior to exposure, corona devices are used to perform a variety of other functions in the xerographic process. For example, corona devices aid in the transfer of an electrostatic toner image from a reusable photoreceptor to a transfer member, the tacking and detacking of paper to the imaging member, the conditioning of the imaging surface prior, during, and after the deposition of toner thereon to improve the quality of the xerographic copy produced thereby. Both d.c. (d.c. potential connected to the coronode) and a.c. (a.c. potential connected to the coronode) type corona devices are used to perform many of the above functions.

The conventional form of corona discharge device for use in reproduction systems of the above type is shown generally in U.S. Pat. No. 2,836,725 in which a conductive corona electrode in the form of an elongated wire is connected to a corona generating d.c. voltage. The wire is partially surrounded by a conductive shield which is usually electrically grounded. The surface to be charged is spaced from the wire on the side opposite the shield and is mounted on a grounded substrate. Alternately, a corona device of the above type may be biased in a manner taught in U.S. Pat. No. 2,879,395 wherein an a.c. corona generating potential is applied to the conductive wire electrode and a d.c. potential is applied to the conductive shield partially surrounding the electrode to regulate the flow of ions from the electrode to the surface to be charged. Other biasing arrangements are known in the prior art and will not be discussed in great detail herein.

Several problems have been historically associated with such corona devices. One major problem has been their inability to deposit a relatively uniform negative charge on an imaging surface. Another problem has been the growth of chemical compounds on the coronode which eventually degrades the operation of the corona device. Yet another problem has been the degradation in charging output resulting from toner accumulations on the coronode and surrounding shield structure. One still further problem is wire vibration which leads to arcing and wire fracture. These problems, among others, are specifically addressed in the aforementioned applications in which there are proposed novel corona discharge configurations which substantially reduce or alleviate the problems noted above, and other problems associated with prior art corona devices, as is discussed more fully therein.

By way of summary, the aforementioned application Ser. No. 595,656 discloses a novel corona device for use in electrostatic reproduction machines which comprise a corona discharge wire coated with a relatively thick dielectric coating, the thickness of the coating being sufficient to prevent the flow of conduction current from the wire. Generation of charge is accomplished by means of a voltage at the dielectric surface established by capacitative coupling through the dielectric material. The magnitude of the flow of charge to the surface to be charged is regulated by the application of a d.c. bias potential to a conductive shield adjacent the electrode.

U.S. Pat. No. 4,057,723 proposes a modification of the structure of Ser. No. 595,656 whereby an exponential rise in charging current is obtained by supporting the dielectric coated wire contiguous or very near the biased shield.

While the corona devices disclosed in the above noted applications individually solve many problems associated with other known corona devices, it is desirable to provide a corona device which retains the better characteristics of each design. For example, while the device of Ser. No. 595,656 has a uniformity of charge characteristics which is superior to prior art devices, it suffers from the same prior art disadvantages associated with a suspended coronode such as fragility in handling and vibration during operation. On the other hand, while the device of U.S. Pat. No. 4,057,723 exhibits a great degree of ruggedness, it has a less uniform charge output.

OBJECTS AND SUMMARY

It is therefore an object of this invention to provide a compact and rugged configuration for a corona device retaining the best characteristics of the corona devices disclosed in the aforementioned copending application.

It is a further object to provide a corona device in which the corona electrode or coronode is not subject to vibration by being loosely suspended in an electric field; but nevertheless has a charge uniformity characteristic substantially equal to that of the suspended coronode configuration of application Ser. No. 595,656.

A further object is to provide an arrangement wherein the coronode is fixedly supported along its length to provide a rigid surface more easily cleaned and more accurately positioned.

Yet a further object is to provide a corona device which operates under suitable conditions to generate a given level of charging current at operating voltages less than those needed in conventional corona devices and less than required in the configuration disclosed in the aforementioned Ser. No. 595,656 while retaining a high degree of charge uniformity.

These and other objects are attained according to the invention by a corona discharge device including a corona discharge electrode and a conductive biasing member or shield located adjacent the electrode, the electrode comprising a wire coated with relatively thick dielectric material so as to allow only a negligible flow of conduction current therethrough. The generation of charge is accomplished by means of a voltage established at the dielectric surface by capacitive coupling through the dielectric material. The flow of charge to the surface to be charged is regulated by means of a d.c. bias applied to a conductive biasing member which establishes a d.c. electric field between the surface to be charged and the member to direct or sweep the desired charge onto the surface. The electrode is located in contact, along substantially its entire length, with an insulating support surface.

DESCRIPTION OF THE PREFERRED EMBODIMENT

Figure 1:
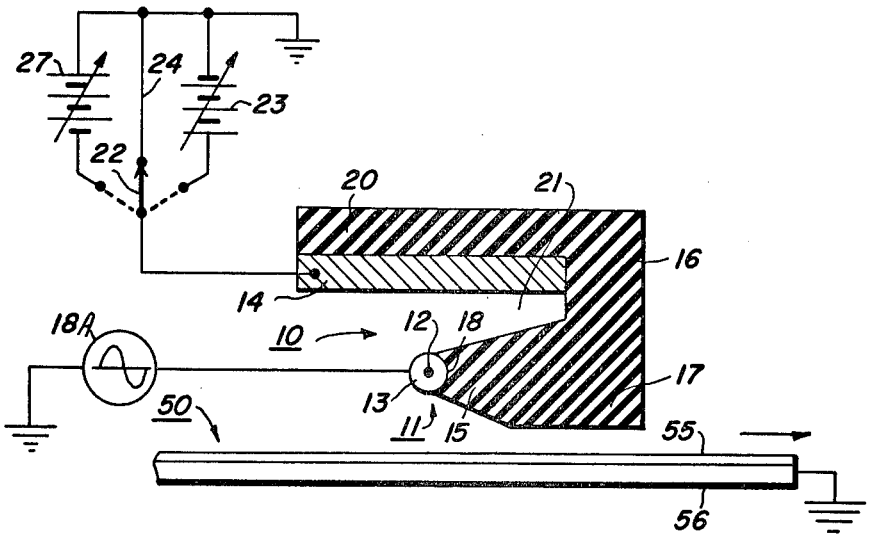
FIG. 1 is a cross section view of one embodiment of the invention and showing an electrical energizing arrangement.

Referring to FIG. 1 of the drawings in which one embodiment of the invention is shown, the corona device 10 of the invention is illustrated as being supported adjacent to an imaging member 50 of a conventional xerographic reproduction machine. The details of construction of the imaging member 50 are well known in the art and do not form a part of this invention. Briefly, however, the imaging member 50 conventionally comprises a photoconductive surface 55 carried by a conductive substrate 56. During operation of the xerographic system, the conductive substrate 56 is held at a reference potential, usually machine ground. During a typical cycle of a xerographic reproduction machine, the imaging member is subjected several times for diverse purposes to charge depositions by corona devices.

The corona generator of the invention includes a coronode or corona discharge electrode 11 in the form of a conductive wire 12 having a relatively thick dielectric coating 13. The wire 12 and coating 13 are shown as having a circular cross section, but other cross sectional shapes such as rectangular may be used satisfactorily.

The coronode 11 is carried on one leg or pedestal 15 of a support block 16, the leg 15 extending from a base portion 17 in a direction generally parallel to the surface of the imaging member 50. The pedestal 15 is tapered in the direction from the base 17 to the electrode 11. The leg 15 includes a surface 18 in contact with the electrode 11, the surface 18 being shaped to complement the contour of the electrode 11. As shown, a concave surface 18 is provided to complement the circular cross-section of the electrode 11. The electrode 11 may be attached to the leg 15 by any suitable means such as an adhesive, or alternately the coating 13 may be molded or otherwise formed to be integral with the leg 15. If an electrode 18 having a planar outer surface were employed the surface 18 would be made flat to complement the outer surface of the electrode 13. While complementary contours of the electrode and contiguous surface of leg 15 provide a better adhesive bond by maximizing contiguous surface area, such complementary contours are not critical to the invention, the important consideration being the provision of a support surface for the electrode along the entire length thereof to maintain it a precise distance from adjacent surfaces.

The support block 16 also includes a second leg 20 which extends from the base 17 in the same direction as the leg 15 and parallel to the imaging surface 50. The legs 14 and 20 and the base 16 jointly define an semi-open cavity 21 in which a plate on conductive biasing member 14 is located. The member 14 may be conveniently attached to leg 20 on the side facing the coronode 11 by any suitable means such as an adhesive, or alternately may be embedded therein.

The lengths of the legs 15 and 20 are selected so that electrode 11 is generally juxtaposed midway of the plate 14 and spaced therefrom approximately the same distance as the distance to the surface 50. It should be noted that the block 15 and the coronode 11 and plate 14 extend the width of the imaging surface so as to enable uniform corona treatment across the width thereof.

The member 14 may take the form of a thin sheet of metal or a metal plate attached to the block 15 and includes an exposed flat surface facing the coronode 11. The member 14 is provided at any convenient portion thereof, preferably outside of the corona discharge area, with a terminal or suitable connection for applying an electrical potential thereto (not shown). Similarly, provisions are made for connecting a suitable source of a.c. potential to the wire 12 as will be explained hereinafter.

It is seen that the leg 15 serves to provide a rigid support for the electrode 11 and hold it a fixed distance from the conductive member 14 and the imaging surface 50. The elimination of vibration caused irregularities in the charge output is thus achieved.

The electrical energization scheme of the corona device of this invention is similar to that disclosed in the aforementioned application Ser. No. 595,656, and U.S. Pat. No. 4,057,723 and the disclosure of this application and patent is hereby incorporated into this application by reference. An a.c. voltage source 18A is connected between the substrate 56 and the corona wire 12, the value of the a.c. potential being selected to generate a corona discharge adjacent the electrode 11.

The biasing member or shield 14 operates to control the magnitude and polarity of charge delivered to the surface 50. To that end, the member 14 has coupled thereto a switch 22 which, depending on its position, permits the corona device to be operated in either a charge neutralizing mode or a charge deposition mode. With the switch 22 in the solid line position shown in FIG. 1, the member 14 of the corona device is coupled to ground via a lead 24. In this position, no d.c. field is generated between the biasing member 14 and the surface 50. In this condition no net d.c. charge is delivered to the surface 50 resulting in the neutralization of accumulated charges thereon under proper condition, as explained in greater detail in the aforementioned application. With the switch 22 in the right most dotted line position, source 23 is connected and negative charge is driven to the surface 50, the magnitude of the charge deposited depending on the value of the applied potential. In the left most dotted line position of switch 22, the positive terminal of a d.c. source 27 is coupled to the member 14. Under these conditions, the corona device operates to deposit a net positive charge onto the surface 50, the magnitude of this charge dependent on the magnitude of the d.c. bias applied to the biasing member 14.

The wire 12 may be made of any conventional conductive filament material such as stainless steel, gold, aluminum, copper, tungsten, platinum or the like. The diameter of the wire 12 is not critical and may vary typically between 0.5 – 15 mil. and preferably is about 3–6 mils.

Any suitable dielectric material may be employed as the coating 13 which will not break down under the applied corona a.c. voltage, and which will withstand chemical attack under the conditions present in a corona device. Inorganic dielectrics have been found to perform more satisfactorily than organic dielectrics due to their higher voltage breakdown properties, and greater resistance to chemical corrosion in the corona environment, and ion bombardment.

The thickness of the dielectric coating 13 used in the corona device of the invention is such that substantially no conduction current or d.c. charging current is permitted therethrough. Typically, the thickness is such that the combined wire and dielectric diameter falls in the range from 3.5 – 50 mil with typical thickness of the dielectric of 1.5 – 25 mil with sufficiently high dielectric breakdown strengths. Several commercially available glasses have been found by experiment to perform satisfactorily as the dielectric coating material. The glass coating selected should be free of voids and inclusions and make good contact with or wet the wire on which it is deposited. Other possible coatings are ceramic materials such as Alumina, Zirconia, Boron Nitride, Beryllium Oxide and Silicon Nitride. Organic dielectrics which are sufficiently stable in corona may also be used.

The frequency of the a.c. source 18A may be varied widely in the range from 60 hz. commercial source to several megahertz. The device has been operated and tested at 4KHz, and also been found to operate satisfactorily under conditions typical of the xerographic process in the range between 1KHz and 50KHz.

The biasing member or shield 14 has been shown as being flat and rectangular in shape but different shapes may be employed with satisfactory results.

Figure 2:
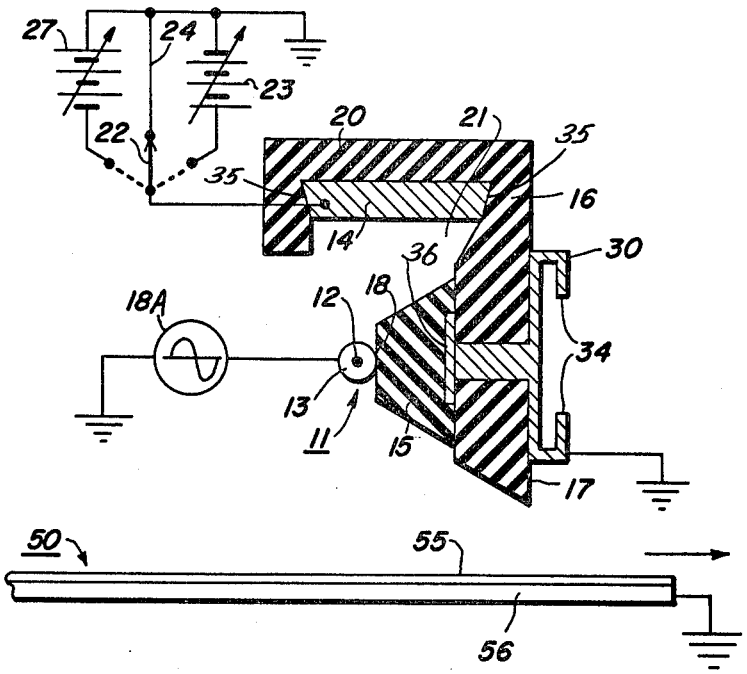
FIG. 2 is a cross-sectional view of a second embodiment of the invention.

An alternate embodiment of the invention is shown in FIG. 2 in which the same numerals used in FIG. 1 have been employed to identify functionally similar elements. In the embodiment of FIG. 2, the plate 14 is again oriented in a plane parallel to the plane of the imaging surface 55 and on the side of the electrode 11 opposite the surface 55. The plate 14 of FIG. 2 has side surfaces 35 inclined at an angle to the axis of the plate to interfit into a complementarily shaped groove or slot in leg 20 of the support block 16. The support pedestal 15 of FIG. 2 is a separate member and in the form of a elongated trapazoidal member 15 attached by an elongated conductive fastener bar 30 to the base 17 of the dielectric support block. The electrode 11 is held to the top flat surface of the member 15 by any suitable means such as adhesive or the like. The bar 30 is closely spaced and runs parallel to the electrode 11 along the full length thereof. The fastener bar 30 has formed on the exposed portion thereof a pair of arms 34 which are shaped to slide onto a suitable support rail of the machine frame (not shown) to hold the corona device in a position for charging the surface 55. Since the frame of the machine is typically at electrical ground, a ground line is illustrated in FIG. 2 as being connected to the fastener bar 30. The portion of the bar 30 nearest the wire 12 has a flat face 36 facing the coronode 11. The use of a grounded electrically conductive bar 30 which is embedded in the dielectric support for the coronode 11 and arranged in close proximity to the wire 12 produces a higher electric field intensity in the area adjacent the coronode 11 relative to the arrangement of FIG. 1. This reduces the threshold potential at which corona discharge takes place. The electric field intensity is increased because the bar 30 constitutes a ground or constant potential plane more closely located to the electrode 11 than any other conductive member.

In operation, when a corona generating a.c. voltage is applied to the wire 12, ions of both polarities are generated in the vicinity of the dielectric coating 13. These ions are diverted toward the conductive surface 14 and 56 in accordance with the magnitude of the biasing voltages thereon and the electric fields that permeate the device, as discussed in the aforementioned copending applications. The use of the grounded bar 30 embedded in the dielectric support in close proximity to the electrode increases the number of ions available at the coronode for direction to the adjacent surfaces.

It will be understood that this invention is susceptible to modification in order to adapt it to different usages and conditions and accordingly it is desired to comprehend such modifications within this invention as may fall within the scope of the appended claims.

What is claimed is:

1. In combination;

a dielectric support having two spaced upstanding legs, a imaging surface oriented in a plane generally parallel to the planes containing said legs, the leg closest to said surface supporting an insulated wire, an a.c. corona generating potential coupled to said wire, and the other of said legs carrying a conductive member facing said wire and coupled to a reference potential.

2. The combination recited in claim 1 wherein said legs form a unitary support including a base from which said legs extend.

3. The combination recited in claim 2 wherein a conductive bar is mounted within said closest leg and spaced from said wire, said bar being coupled to a constant reference potential.

4. The combination recited in claim 3 wherein said reference potential is ground.

5. A corona device comprising: a unitary dielectric support having a base from which extend a first and second leg forming at least a partial cavity therebetween;

an insulated corona wire mounted on the end of said first leg a conductive member mounted on said second leg and within said cavity so as to face the wire, means for applying an a.c. corona generating voltage to said wire and means for applying a reference potential to said conductive member.

6. The combination recited in claim 5 further including an imaging surface, said wire located intermediate said conductive member and said surface.

7. The combination recited in claim 6 wherein said imaging surface is oriented in a plane generally parallel to the planes containing said legs.

8. The combination recited in claim 5 wherein the end of said first leg includes a concave surface whereby said wire is mounted within and against said concave surface.

9. The combination recited in claim 5 wherein a conductive bar is mounted within said first leg and spaced from said wire, said bar being coupled to a constant reference potential.

10. The combination recited in claim 9 wherein said reference potential is ground.

* * * * *